United States Patent [19]

Tada

[11] Patent Number: 4,940,186

[45] Date of Patent: Jul. 10, 1990

[54] MANUALLY OPERATED TRIGGER TYPE DISPENSER, A SPINNER FOR USE IN THE DISPENSER, AND A FLOW-PATTERN SWITCHING MECHANISM FOR USE IN THE DISPENSER

[76] Inventor: Atsushi Tada, 2-6-3 Kakinokizaka, Meguro-ku, Tokyo, Japan

[21] Appl. No.: 259,274

[22] Filed: Oct. 18, 1988

[51] Int. Cl.[5] ..... B05B 11/00; B05B 1/34

[52] U.S. Cl. ..... 239/337; 239/333; 239/468; 239/471; 222/383; 222/340

[58] Field of Search ..... 222/383, 340, 380; 239/337, 339, 375, 333, 468, 469, 470, 471, 474, 475, 322

[56] References Cited

U.S. PATENT DOCUMENTS

| | | | |
|---|---|---|---|
| 3,061,202 | 10/1962 | Tyler | 222/383 |
| 3,685,739 | 8/1972 | Vanier | 239/333 |
| 3,768,734 | 10/1973 | Anderson, Jr. et al. | 222/383 |
| 3,840,157 | 10/1974 | Hellenkamp . | |
| 4,220,285 | 9/1980 | Gualdi | 222/383 |
| 4,227,650 | 10/1980 | McKinney . | |
| 4,358,057 | 11/1982 | Burke | 239/333 |
| 4,371,097 | 2/1983 | O'Neill . | |
| 4,591,077 | 5/1986 | Corsette | 222/383 |
| 4,596,344 | 6/1986 | Corsette | 239/333 |
| 4,624,413 | 11/1986 | Corsette | 222/383 |
| 4,691,849 | 9/1987 | Tada . | |
| 4,815,663 | 3/1989 | Tada | 239/333 |

FOREIGN PATENT DOCUMENTS 62-94566 5/1987 Japan .

*Primary Examiner*—Andres Kashnikow
*Assistant Examiner*—Christopher G. Trainor
*Attorney, Agent, or Firm*—Frishauf, Holtz, Goodman & Woodward

[57] ABSTRACT

A dispenser body comprises an upper portion and a lower portion vertically extending from the upper portion. A piston is substantially L-shaped, comprising a horizontal nozzle fixed to the upper portion and a piston body located at the lower portion. A cylinder is coupled with a swingable trigger and located at the lower portion; it can reciprocate when the trigger is squeezed and released. An inlet conduit is formed within the cylinder, whereas an outlet conduit is provided within the piston. A slit is cut in the front section of the lower portion. Thanks to this slit, the lower portion is resiliently fitted in a bottle cap and, thus, connected thereto. The rear end of the trigger and the nozzle can pass through this slit. The proximal end of the bottle cap is held between the lower edge of the rear section of the lower portion and an engagement member formed on the lower portion.

7 Claims, 14 Drawing Sheets

MANUALLY OPERATED TRIGGER TYPE DISPENSER, A SPINNER FOR USE IN THE DISPENSER, AND A FLOW-PATTERN SWITCHING MECHANISM FOR USE IN THE DISPENSER

BACKGROUND OF THE INVENTION

This invention relates to a manually operated trigger type dispenser which is adapted to be detachably attached to a liquid container, comprises a trigger and a cylinder having a pump chamber, said trigger being squeezed to suck up the liquid from the container into the pump chamber and to pressurize the liquid, so as to dispense the liquid. The invention also relates to a spinner for use in the dispenser, which is designed to swirl the liquid pressurized in the pump chamber, and a flow-pattern switching mechanism for use in the dispenser.

A conventional manually operated trigger type dispenser comprises a dispenser body which is adapted to be detachably attached to the neck of a liquid container. The dispenser body is molded of synthetic resin such as polyethylene, and includes an upper portion and a lower portion. An actuating lever, or a trigger, is swingably pivoted to the upper portion of the dispenser body. The lower portion of the dispenser body is cylindrical, and adapted to be attached to the neck of the liquid container, either directly or by a cap. The lower portion extends from the upper portion, substantially at right angles to the upper portion. A cylinder defining a pump chamber is incorporated in the dispenser body. An inlet conduit, which communicates with the pulp chamber, is provided within the dispenser body, and has an axis extending vertically. An outlet conduit, which communicates with pump chamber, is provided within the dispenser body.

More specifically, the inlet conduit is formed in the lower portion of the dispenser body and extends almost vertically, whereas the outlet conduit is formed in the upper portion of the dispenser body and extends almost horizontally. Hence, the axes of the inlet and outlet conduits intersect with each other, substantially at right angles.

The cylinder is integrally molded with the upper portion of the dispenser body, and is coaxial with the outlet conduit. A piston is provided within the cylinder and coupled to the trigger. This piston reciprocates in a substantially horizontal direction as the trigger is squeezed and released. As is disclosed in, for example, U.S. Pat. Nos. 3,840,157 (Hellenkamp) and 4,227,650 (McKinney), another trigger type dispenser is known which comprises an upper dispenser body portion having a substantially horizontal, cylindrical portion having an outlet conduit, a cylinder integrally molded with the upper dispenser body portion and extending vertically therefrom, and a piston provided within the cylinder and being able to move up and down. In this dispenser, an inlet conduit is formed within the piston, not in the lower dispenser body portion. Nonetheless, the axis of the cylinder, which is integrally molded with the upper dispenser body portion, intersects at right angles with the axis of the outlet conduit.

As is disclosed in, for example, U.S. Pat. No. 4,371,097 (O'Neil), still another trigger type dispenser is known in which the piston is incorporated in the dispenser body and the cylinder vertically reciprocates along the piston. In this dispenser, the outlet conduit is formed in the upper portion of the dispenser body, whereas the inlet conduit is formed in the lower portion of the dispenser body. A cylindrical portion, whose axis extends at right angles to the axis of the outlet conduit, extends vertically from the upper dispenser body portion.

The cylinder, the piston, the trigger, the cap, and the like—all being main components of any conventional dispenser described above—are made of synthetic resin by injection molding, like the dispenser body.

The molding of the dispenser body of any prior art trigger type dispenser described above is accompanied by the following problems.

Were the dispenser body a single cylindrical component, it could be easily molded, merely by moving a movable mold with respect to a stationary mold. Actually, however, the dispenser body is a combination of two cylindrical components, extending at right angles to each other, i.e., the upper and lower cylindrical body portions, the upper body portions the upper body portion and the cylinder, or the upper body portion and the cylindrical portion. Therefore, during the molding process, cores must be moved vertically in the plane perpendicular to the direction in which the movable mold is moved. In other words, the cores must be moved in the direction of arrow Y shown in FIG. 19, or in the direction opposite to arrow Y. Consequently, cavities 202, each for molding a dispenser body, cannot be arranged in more than two rows, spaced apart in the direction of arrow Y, in stationary mold 204, as is shown FIG. 19. No cavities can be formed in that portion of mold 204 which lies between those two portions in which the two rows of cavities 202 are made. The number of dispenser bodies, which can be molded in each injection cycle, is inevitably limited.

The dispenser body is more complex in structure than the other components of the dispenser, such as the piston and the trigger. Molten plastic material is injected into cavities 202 under a high pressure. Nevertheless, the plastic material cannot fill up cavities 202 quickly, because of the complex shape of cavities 202, which increases the injection time. In addition, some time is required to move the cores. As a consequence, the injection cycle is prolonged, making it difficult to massproduce the dispenser body. Furthermore, since the cavities 202 have a complex shape the movable and stationary molds cannot be manufactured at low cost.

In order to manufacture a trigger type dispenser at low cost, it is necessary not only to produce a simple dispenser body in large quantitites, but also to put the dispenser body together with the other components within a short time. The components of the conventional dispenser, such as the trigger, the piston, the cylinder, and the cap, cannot be easily fitted into or coupled with, the dispenser body. Thus, the prior art dispenser cannot be assembled within a sufficiently short time.

Most trigger type dispensers have a return spring which is interposed between the piston and the cylinder. Hence, the piston (or the cylinder, in the dispenser disclosed in U.S. Pat. No. 4,371,097), which is movable, is pushed outward by the return spring, and is separated from the cylinder in some cases. None of the conventional trigger type dispensers have a unit comprising a piston, a cylinder and a return spring—all put together, not separated from one another. As a consequence, the prior art dispensers must be assembled in the same factory, from the first step to the last step. In other words, they cannot be manufactured in a knock-down scheme.

Any type of a trigger type dispenser has a nozzle cap attached to the distal end of the nozzle, and a spinner interposed between the nozzle and the nozzle cap. The spinner used in the conventional dispensers is a bottomed cylinder made of synthetic resin. A recess is cut in the center of the distal end surface of the spinner. A pair of grooves are cut in the distal end surface, and extend tangent to the recess. Two through holes are cut in the bottom of the spinner and extend in parallel to the axis of the spinner. These through holes connect the grooves to the fluid passage of the nozzle. An orifice is made in the center of the nozzle cap, and is coaxial with the recess of the spinner.

When the trigger is squeezed, the liquid pressurized within the cylinder flows into the recess of the spinner through the liquid passage, the through holes, and the grooves. Since the grooves extend tangentially to the recess, the liquid swirls as it flows from the grooves into the recess, and is collected at the center of the recess, and is dispensed through the orifice of the nozzle cap.

A trigger type dispenser is known, wherein an annular space is provided between the spinner and the inner periphery of the nozzle, instead of forming two through holes in the spinner. This annular space functions as a liquid passage, through which the pressurized liquid flows from the nozzle into the tangential grooves of the spinner.

A problem is inherent in the conventional trigger type dispensers. The liquid passage of the nozzle is always connected to the orifice communicating with the atmosphere, by the tangential grooves and the recess of the spinner. Therefore, when the trigger is squeezed by mistake, the liquid is likely to leak through the passage of the nozzle and the orifice of the nozzle cap. Even if the trigger has been locked, the liquid passage of the nozzle remains open to the atmosphere, and the liquid remaining in the spinner and the nozzle, will unavoidably leak from the nozzle.

SUMMARY OF THE INVENTION

Accordingly it is a primary object of the present invention to provide a manually operated trigger type dispenser which comprises a dispenser body able to be manufactured in large quantities, and which can therefore be manufactured in a knock-down scheme.

It is another object of the invention to provide a spinner for use in a dispenser, which can be readily molded and the use of which does not render the dispenser complicated in structure.

It is a further object of the present invention to provide a dispenser which is simple in structure and yet can completely prevent a leakage of liquid when not used.

It is still another object of this invention to provide a mechanism of use in a dispenser, which is adapted to switch a liquid swirl pattern to another by moving the nozzle cap of the dispenser in the axial direction of the cap, and to lock the nozzle cap at an appropriate off-position while the dispenser is not used.

To achieve the primary object of the invention, neither an inlet conduit nor an outlet conduit is formed in the dispenser body, and a piston and a cylinder are not integrally molded with the dispenser body.

The dispenser body comprises an upper portion and a lower portion vertically extending from the upper portion. The piston is substantially L-shaped, comprising a horizontal nozzle fixed to the upper portion of the dispenser body, and a piston body located at the lower portion of the dispenser body. The cylinder is coupled with a swingable trigger and located at the lower portion of the dispenser body; it can reciprocate when the trigger is squeezed and released. The inlet conduit is formed within the cylinder whereas the outlet conduit is provided within the piston. A slit is cut in the front section of the lower body portion and an engagement member, with which the proximal end of a bottle cap engages, is formed on the lower body portion. Thanks to this slit, the proximal end of the bottle cap is resiliently fitted in the lower body portion and, thus, slipped into the gap between the engagement member and the lower edge of the rear section of the upper body portion.

Other objects, advantages and novel features of the invention will become more apparent from the following detailed description of the invention when taken in conjunction with the accompanying drawings.

DETAILED DESCRIPTION OF THE PREFERRED EMBODIMENT

Figure 1:
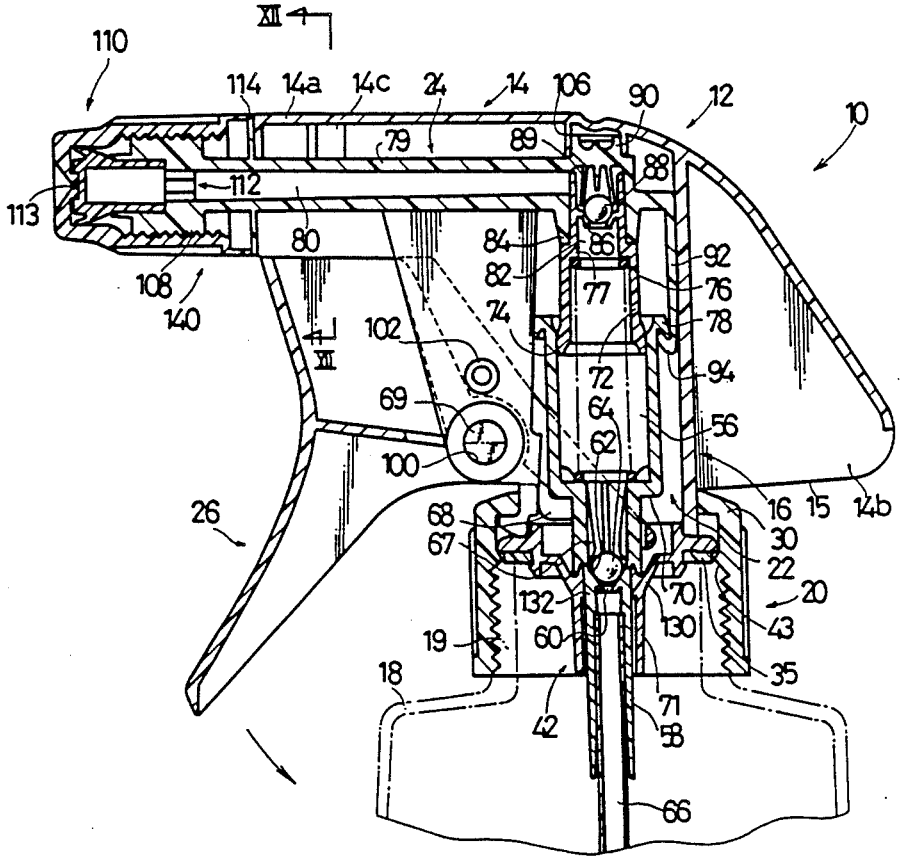
FIG. 1 is a longitudinal sectional view schematically showing a manually operated trigger type dispenser according to the present invention.

FIG. 1 shows a manually operated trigger type dispenser 10 according to this invention. As is shown in this fixture, the dispenser 10 comprises a dispenser body 12 made of synthetic resin, such as polyethylene, by means of injection molding. The dispenser body 12 includes an upper body portion 14 and a lower body portion 16. The lower body portion 16 extends from the upper body portion 14 in a substantially vertical direction. The lower end of this body portion 16 is adapted to be detachably connected to the neck 19 of a container 18 containing the liquid to be dispensed, by means of a bottle cap 20.

The dispenser 10 further comprises a cylinder 22, a piston 24, and a trigger 26. Like the dispenser body 10, the cylinder, the piston, and the trigger are made of synthetic resin by means of injection molding.

Figure 2:
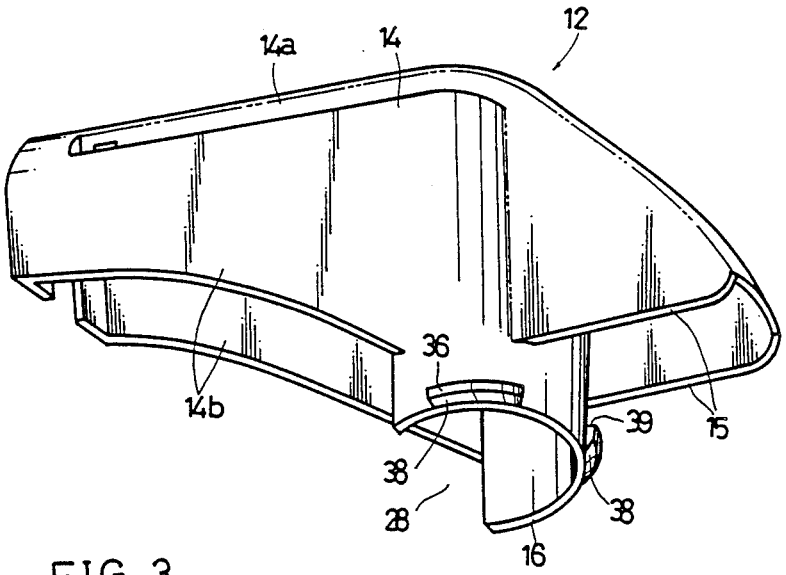
FIG. 2 is a perspective view of the dispenser body of the trigger type dispenser shown in FIG. 1.

As will be evident from FIG. 2, the upper body portion 14 comprises a top portion 14*a* and a pair of side walls 14*b*. The side walls 14*b* are integrally molded with the top portion 14*a* and extend downward from the lateral edges of top portion 14*a*. As will be described later, the piston 24 is arranged in the gap between these side walls 14*b*, and the trigger 28 is swingably pivoted to the piston 24, not to the dispenser body 12. The lower body portion 16 has a slit 28 in the front. The lower end of the body portion 16 is therefore resiliently bendable. An engagement member 36, which is adapted to fit the lower end of the lower body portion 16 into the proximal end 30 of a bottomed bottle cap 20, is formed on the lower body portion 16, as is illustrated in FIG. 3.

Figure 3:
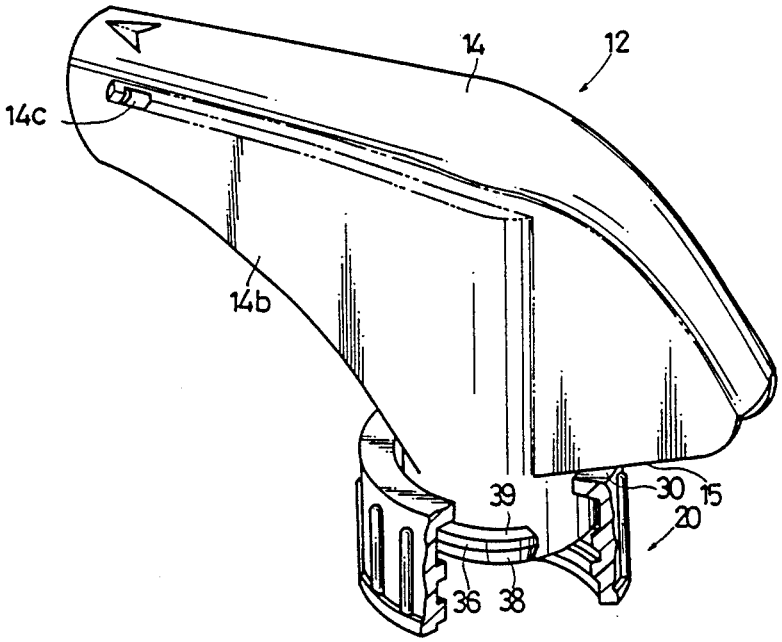
FIG. 3 is a perspective view of the dispenser body and a bottle cap in which the lower end of the dispenser body is fitted, said bottle cap being partly cut away.

As is shown in FIGS. 2 and 3, the engagement member 36 is a flange protruding from the lower end of the body portion 16; it is positioned below the lower edge 15 of rear section of the upper body portion 14 such that the proximal end 30 of the bottle cap 20 is clamped between the engagement member 36 and the lower edge 15 of rear section of the upper body portion 14. The engagement ember 38 has a lower surface 38 which is inclined, and an upper surface 39 which is horizontal and parallel to the lower surface of the proximal end 30 of the bottle cap 20. The engagement member 36 can be formed on either side of the lower end of the lower body portion 14. Front and rear portions of the engagement member 36 have large notches, whereby the engagement member 36 can easily be molded. Needless to say, the engagement member 36 can have shape other than one shown in FIGS. 2 and 3.

The bottle cap 20 has an internally threaded portion. The neck 19 of the container 18 has an externally threaded portion. The threaded portion of the bottle cap 20 can be put in screw engagement with the threaded portion of the neck 19, so that the bottle cap 20 may be detachably connected to the neck 19 of the container 18. As is shown in FIG. 1, a sealing collar 42 is provided within the bottle cap 20. Once the lower body portion 16 has been attached to the neck 19 of the container 18 by means of the bottle cap 20, the lower end of the lower body portion 16 is engaged with the upper end of the sealing collar 42, which is located on a projection 43 of the nozzle cap 22. The upper end of the sealing collar 42 is clamped between the lower end of the lower body portion 16 and the upper end of the neck 19, whereby the lower body portion 16 is coupled to the container 18 in watertight fashion. A plastic washer 35 is attached on lower surface of the sealing collar 42.

It will now be explained how the bottle cap 20 and the sealing collar 42 are incorporated into the lower 10 body portion 16 of the dispenser body 12.

First, the bottle cap 20 is pressed onto the lower body portion 16. Then, the proximal end 30 of the bottle cap 20 is guided by the lower surf 38 of the engagement member 36, while slightly collapsing the lower end of the lower body portion 16, and slips into the gap between the engagement member 36 and the lower edge 15 of the rear section of the lower body portion 16. As soon as the proximal end 30 slips into the gap between the member 36 and the lower edge 15 of the rear section of the lower body portion 16, the lower end of the lower body portion 16 restores its original shape. The lower edge 15 of the lower body portion 16 prevents the proximal end 30 from moving further upward. The upper surface 39 of the engagement member 36 prevents the proximal end 30 from moving downward. Since the upper surface 39 is parallel to the lower surface of the proximal end 30, the bottle cap 20 is reliably prevented from falling from the lower body portion 16. The upper surface 39 of the engagement member 36, therefore, functions as a stopper. Thus, the bottle cap 20 is attached to the lower body portion 16.

Thereafter the sealing collar 42 is pushed within the bottle cap 20, and forced into the lower body portion 16 of the dispenser body 12. The sealing collar 42 slips on the projection 43 of the bottle cap 20. Thus, the sealing collar 42 is attached to the lower body portion 16 of the dispenser body 12.

Both the bottle cap 20 and the sealing collar 42 are connected to the dispenser body 12 before the bottle cap 20 is put into screw engagement with the neck 19 of the container 18. As will be later described, the bottle cap 20 and the sealing collar 42 are attached to the dispenser body 12, together with the piston 24, the trigger 28, and the cylinder 22.

Figure 5:
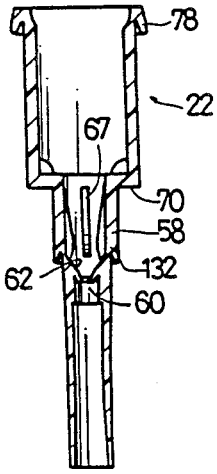
FIG. 5 is a longitudinal sectional view of the cylinder of the dispenser shown in FIG. 1.

As is shown in FIG. 1, and as is shown in FIG. 5 in greater detail, the cylinder 22 comprises a large-diameter section defining a pump chamber 56, and a small-diameter portion 58 molded integrally with the large-diameter section and extending downwardly therefrom. An inlet conduit 60 is formed in the small-diameter section 58. A valve seat 62 is formed in the small-diameter section 48, and a primary valve 64, which is a steel ball, is placed on the valve seat 62. A suction tube 66 has its upper end fitted in the small-diameter section 58 of the cylinder 22, and extends vertically within container 18. The suction tube 66 can be formed integrally with cylinder 22. As is illustrated in FIG. 5, a valve holder 67 is provided within the small-diameter section 58, and prevents the primary valve 64 from moving into the pump chamber 56.

Figure 6:
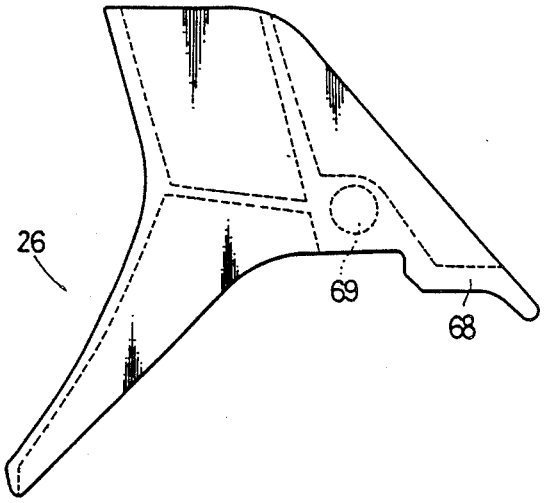
FIGS. 6 and 7 are side view and back view, showing the trigger of the dispenser illustrated in FIG. 1.
Figure 7:
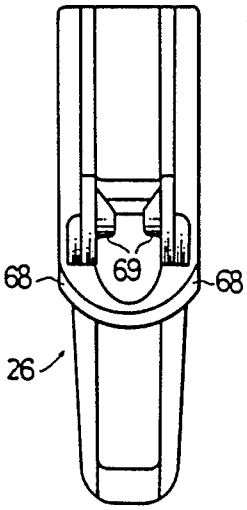

As can be understood from FIGS. 1, 6 and 7, a pair of engagement members 68 protrude from the back of the trigger 26, so as to abut on the stepped portion 70 of the cylinder 22. Therefore, when the trigger 28 is squeezed and swung in the direction of the arrow, as is shown in FIG. 1, the cylinder 22 is moved upward from its non-operational position (i.e., its initial position), along the piston 24. When the trigger 26 is released, it returns to its initial position due to the force of a return spring (later described). The sealing collar 42 has a slender cylindrical portion 71 loosely fitted in the small-diameter section 58 of the cylinder 22. The cylinder 22 is guided by this cylindrical portion 71, and reciprocated. As is shown in FIG. 7, a pair of pins 69 project from the opposing inner surfaces of the trigger 26. These pins 69 are loosely fitted in holes 100 out in a pair of brackets 89 which will later described, whereby the trigger 26 is swingable with respect to the piston 24.

As is illustrated in FIG. 1, the cylinder 22 has an open upper end. The body of the piston 24, i.e., piston body 72, has its lower end inserted in the cylinder 22. A flared seal 74 is integrally molded with the lower end of the piston body 72. The flared seal 74 is in sliding contact with the inner periphery of the cylinder 22, and thus guides the cylinder 22 upward and downward. The return spring 76, for example, a compression coil spring, is inserted in the cylinder 22, with its upper end abutting on the stepped portion 77 of the piston body 72.

An annular engagement member 78, which has a hook-shaped cross section, is integrally formed with the upper end of the cylinder 22, and slightly extends outwardly. As will be described later the annular engagement member 78 engages with a hook-shaped support member integrally formed with the piston 24. Therefore, the cylinder 22 is supported by the piston 24 and located in its initial position.

Figure 8:
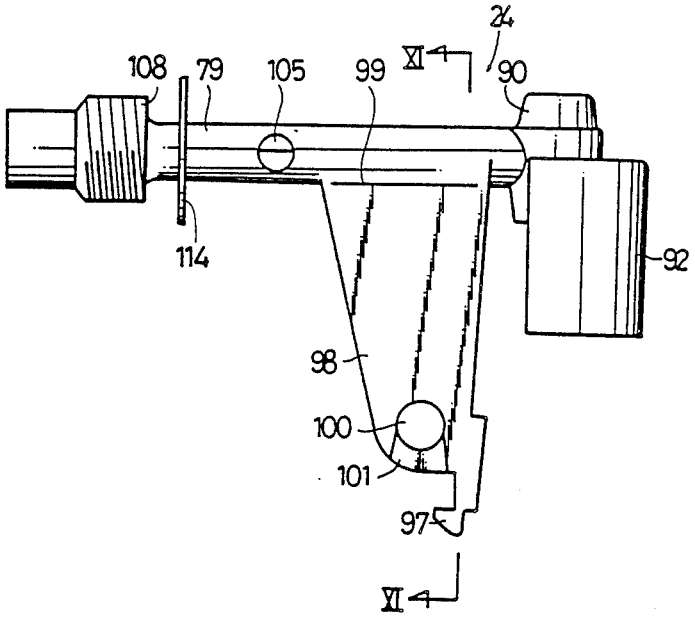
FIGS. 8, 9 and 10 are side view, plan view, and front view, showing the nozzle of the piston used in the trigger type dispenser shown in FIG. 1.
Figure 11:
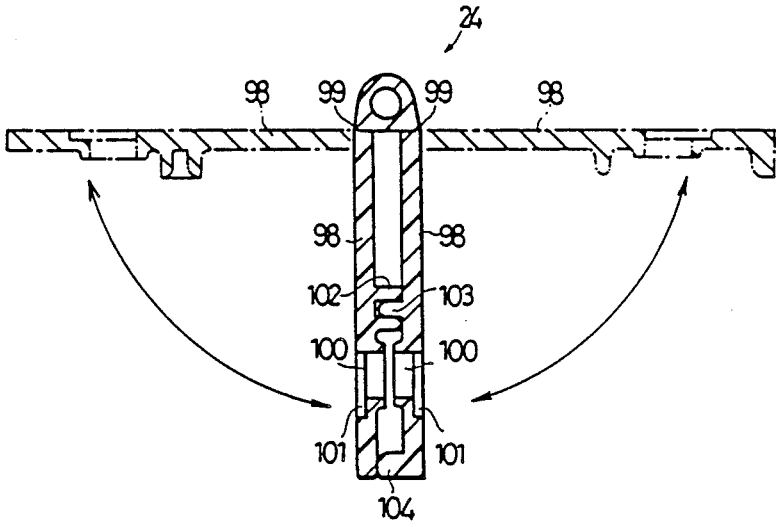
FIG. 11 is a sectional view of the piston, taken along line XI—XI in FIG. 8.

As is shown in FIG. 1, and as is more specifically shown in FIGS. 8 and 11, the piston 24 is substantially L-shaped and composed of the piston body 72 extending vertically, and a nozzle 79 extending horizontally. The piston body 72 guides the cylinder 22 as the cylinder 22 moves up and down. A nozzle cap 110 is attached to the distal end of the nozzle 79. An outlet conduit 80 is formed in the nozzle 79 and communicates with the orifice of the nozzle cap 110. A connection conduit 82 is formed in the piston body 72, and connects the outlet conduit 80 to the pump chamber 56.

As is evident from FIG. 1, the piston body 72 and the nozzle 79 have been separately molded. The piston body 72 is fitted in connection cylinder 84 integrally molded with the rear end of the nozzle 79, thereby forming the piston 24. A valve seat 86 is integrally molded with the upper end of the piston body 72. A secondary valve 88, which is a steel ball, is mounted on the valve seat 86, that is, on the upper end of the piston body 72, thus blocking the communication between the outlet conduit 80 and the connection conduit 82. The piston body 72 and the nozzle 79 can be integrally molded, and the secondary valve 88 can be incorporated in the nozzle 79. A valve holder 89 for the secondary valve 88 is provided within the connection cylinder 84.

Engagement cylinder 90 extends upward from the upper edge of the nozzle 79. This cylinder 90 is coaxial with the connecting cylinder 84. A support cylinder 92 extends downward from the rear end of the nozzle 79, coaxially with the piston body 72. As is clearly shown in FIG. 9, the left half (i.e., the front section) of the support cylinder 92 is cut away. As is shown in FIGS. and 10, a hook-shaped engagement member 94 is formed integrally with the lower end of the support cylinder 92. This member 94 is arcuate, and its hook portion protrudes from the inner periphery of the cylinder 92 and consists of two portions spaced apart from each other. Since the hook portion of the engagement member 94 is composed of two portions, the nozzle 79 can be easily molded, merely by inserting cores through a holes 96 made in the upper end of the support cylinder 92. For the same reason, the hood portion of the engagement member 94 is rendered elastic enough to engage with the annular engagement member 78 of the cylinder 22.

Figure 9:
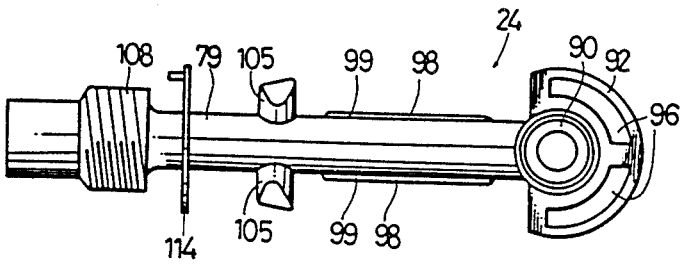
Figure 10:
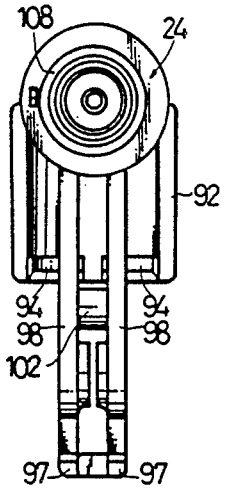

As is shown in FIGS. 8 and 9, a pair of plates 98 are integrally formed with a hinge 99 which is the middle portion of nozzle 79. A pair of hooks 97, which can engage with the proximal end 30 of the bottle cap 20, are formed integrally with the lower ends of the hinged plates 98. A hole 100 is made in each lower end portion of the plate 98. Around the axis of this hole 100, the trigger 26 is swung. Two guide recesses 101 are cut in those portions of the plates 98 which are located below the hole 100.

The trigger 26 is pushed up into the lower end of the nozzle 79, with the pins 69 axially aligned with the holes 100 of the plates 98. The pins 69 are guided upward by the guide recesses 101, and eventually fitted into the holes 100. As a result, the trigger 26 is pivotally attached to the nozzle 79. Once the pins 69 have been fitted into the holes 100, the tagger 26 cannot be detached easily from the nozzle 79. As can be understood from FIG. 7, the rear ends of the two parallel walls forming the trigger 26 are connected such that the trigger 26 is prevented from falling off the nozzle 79.

In this embodiment, the pins 69 protrude from the inner surfaces of the parallel walls of the trigger 26, and the holes 100 are made in the plates 98 of the nozzle 79. Alternatively, the pins 69 can be formed on the inner surfaces of the plates 98, and the holes 100 can be cut in the parallel walls of the trigger 26.

Both plates 98 can be rotated, with the hinge 99 acting as a fulcrum. More specifically, the piston 24 is molded, with the plates 98 extending horizontally as is indicated by the one-dot chain lines in FIG. 11. These plates 98 are rotated downwardly until they are positioned vertically and parallel to each other. The plates 98 must be spaced apart for such a distance that the pins 69 of the trigger 26 are reliably fitted into the holes 100. To set the plates 98 apart for this distance, an engagement cylinder 102 protrudes from the inner surface of one of the plates 98, and an engagement projection 103 protrudes from the inner surface of the other plate 98 and is fitted in the engagement cylinder 102. Therefore, the trigger 26 is pivotally attached to the piston 24 reliably. A projection 104 protrudes inwardly from the lower end of the right plate 98 as is shown in FIG. 11. Due to this projection 104 neither plate 98 is bent inwardly when the pins 69 of the trigger 26 are fitted into the holes 100 of the plates 98. Hence, the pins 69 are prevented from slipping out of the holes 100, ensuring the pivotal attaching of the trigger 26 to the piston 24.

As has been described, the nozzle 79 of the piston 24 is molded, with both plates 98 extending horizontally. Therefore, it suffices to cut two shallow cavities in the mold for forming the nozzle 79, both being located near the parting line of the mold. Were the nozzle 79 molded, with the plates 79 extending vertically, two deep cavities for forming the plates 98 should be made in the mold, and the mold should be very complex in structure. In the present embodiment, since the cavities for forming the plates 98 are shallow, the mold for forming the nozzle 79 is simple in structure and hence, can be manufactured at low cost. Since the mold is simply structured, the nozzle 79 can be molded easily.

The pair of plates 98 can be spaced apart from each other for the specific distance, in any other way than has been described above.

Figure 4:
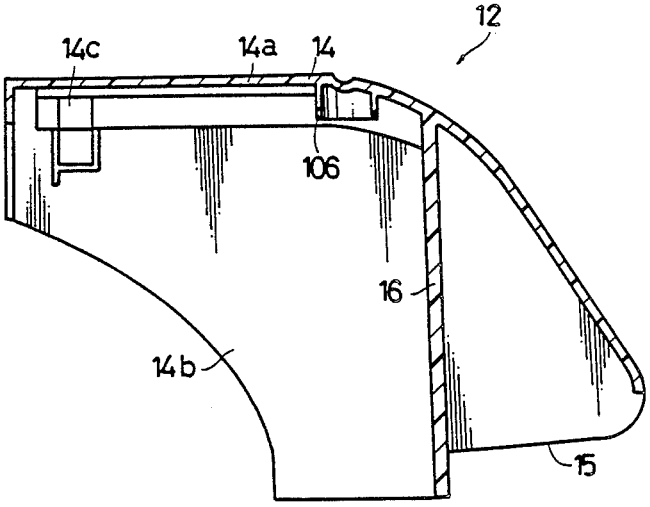
FIG. 4 is a longitudinal sectional view of the dispenser body.
Figure 12:
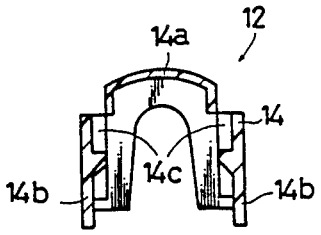
FIG. 12 is a cross-sectional view of the dispenser body, taken along line XII—XII in FIG. 1.

As is illustrated in FIGS. 8 and 9, a pair of engagement projections 105 extend horizontally from the upper edge of the nozzle 79. As is shown in FIGS. 4 and 12, a pair of engagement recesses 14c are made in the inner surfaces of the front-end portions of the opposing side walls forming the dispenser body 12. The engagement projections 105 can be fitted into these engagement recesses 14c. Further, as is shown in FIG. 1, an engagement cylinder 106 protrudes downwardly from the upper edge 14a of the dispenser body 12. This cylinder 106 can be fitted into the engagement cylinder 90 of the nozzle 79. When the nozzle 79 is pushed up into the dispenser body 12, with engagement cylinder 106 axially aligned with the engagement cylinder 90 of the body 12, the cylinder 106 is fitted into the cylinder 90 and the engagement projections 105 are fitted into the engagement recesses 14c, respectively. Thus, the nozzle 79 is attached to the dispenser body 12, being supported at two points, i.e., its front-end portion and its rear-end portion, as is illustrated in FIG. 1. No play is allowed between the dispenser body 12 and the nozzle 79.

Figure 13:
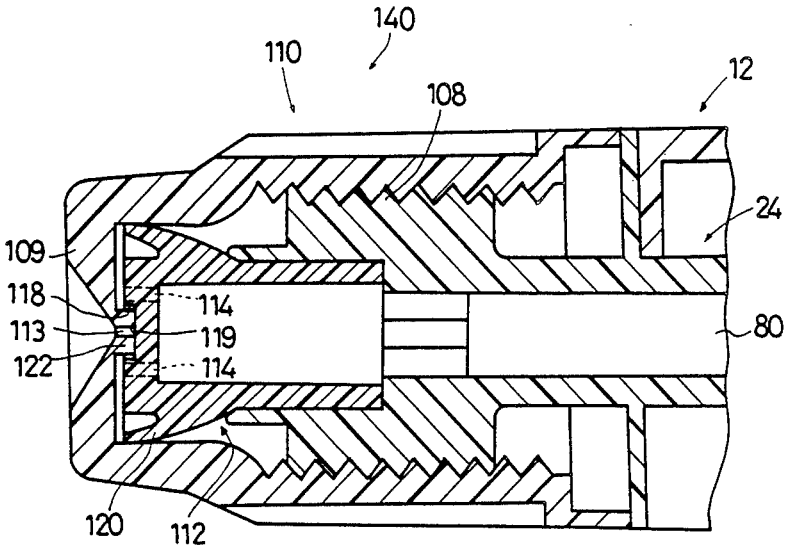
FIG. 13 is a longitudinal sectional view showing the mechanism used in the dispenser of FIG. 1, for switching the liquid-flow pattern to another, said mechanism being set in its off-position.

As is shown FIGS. 1 and 8, the distal end portion 108 of the nozzle 79 is externally threaded. A nozzle cap 110, which is a bottomed hollow cylinder, is mounted on the externally thread portion 108, in screw engagement therewith. A spinner 112 for swirling the pressurized liquid flowing through the outlet conduit 90 is provided within the nozzle 79, being interposed between the nozzle cap 110 and the distal end of the nozzle 79, As is shown in FIG. 13, an orifice 113 is out in the center of the bottom of the nozzle cap 110. The nozzle cap 110 can be rotated in either direction. When the cap 110 is rotated in one direction, it moves forward with respect to the nozzle 79. When the cap 110 is rotated in the opposite direction, it moves backward with respect to the nozzle 79. Hence, the gap between the bottom of the nozzle cap 110 and the distal end of the spinner 112 can be adjusted by rotating the nozzle cap 110, whereby the pressurized liquid can be ejected from the orifice 113, in the form of either a spray stream or a jet stream.

Figure 14:
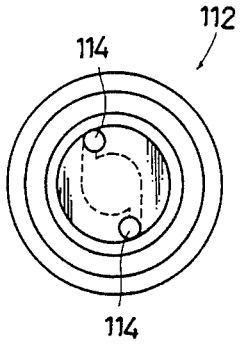
FIGS. 14 and 15 are back view and front view showing the spinner incorporated in the trigger type dispenser illustrated in FIG. 1.
Figure 15:
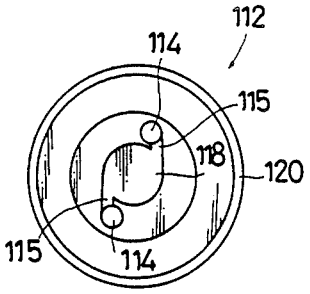
Figure 16:
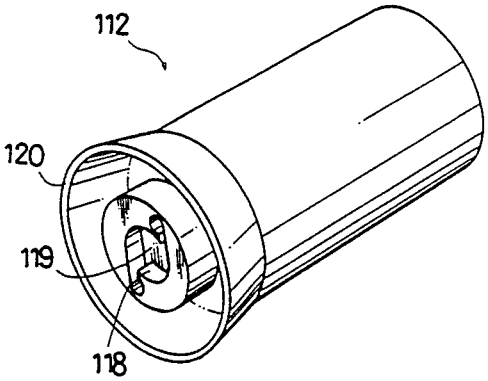
FIG. 16 is a perspective view of the spinner.

The spinner 112, which is interposed between the nozzle 79 and the nozzle cap 110, is made of a synthetic resin. As FIGS. 13 and 14 clearly show, a pair of liquid passages 114 (through holes) are cut in the rear surface of the bottom of the spinner 112. These passages 114 extend parallel to the axis of the spinner 112 and set apart by 180° in the circumferential direction of the spinner 112. The liquid passages 114 have a circular section. Nonetheless, one or, three or more liquid passages having any other cross section can be cut in the spinner 112, and can be differently spaced apart in the circumferential direction of the spinner 112. As is shown in FIGS. 15 and 16, a circular recess 118 is made in the censer of the distal surface of the spinner 112 and a pair of grooves 115 extending tangentially to the recess 118 are cut in the distal end of the spinner 115. This recess 118 communicates with, and is coaxial with, the orifice 113. The circular recess 118 communicates with the liquid passages 114 via the tangential grooves 115. A flared seal 120 extends from the distal end of the spinner 112 and slidably contacts the inner periphery of the nozzle cap 110, whereby the cap 110 and the spinner 112 are coupled in liquid-tight fashion.

The nozzle cap 110 has a cylinder 122 which can enter the circular recess 118 of the spinner 112 to abut the bottom 119 of the recess 118. The cylinder 22 defines the orifice 113.

In order to prevent liquid-locking from occurring within the container 18, a venting means must be provided. Therefore, as is shown in FIG. 1, the stepped portion 130 of the sealing collar 42, and the stepped portion 132 of the small-diameter section 58 of the cylinder 22 are formed such that these portions 130 and 132 constitute a venting means. The small diameter section 58 of the cylinder is loosely fitted in the cylinder portion 71 of the sealing collar 42. The venting means secure airtight connection between the cylinder 22 and the container 18, in spite of its simple structure. When trigger 26 is squeezed, and the cylinder 22 is moved upward from its initial position, the stepped portion 132 moves away from the stepped portion 130 of the sealing collar 42. As a result, the interior of the container 18 communicates with the atmosphere via the gap formed between the cylinder 22 and the sealing collar 42, whereby air flows into the container 18 through the gap, thereby preventing liquid-looking within the container 18.

Trigger type dispenser 10, which has been described above, can be assembled easily, in a few steps, as will be explained below.

Figure 17:
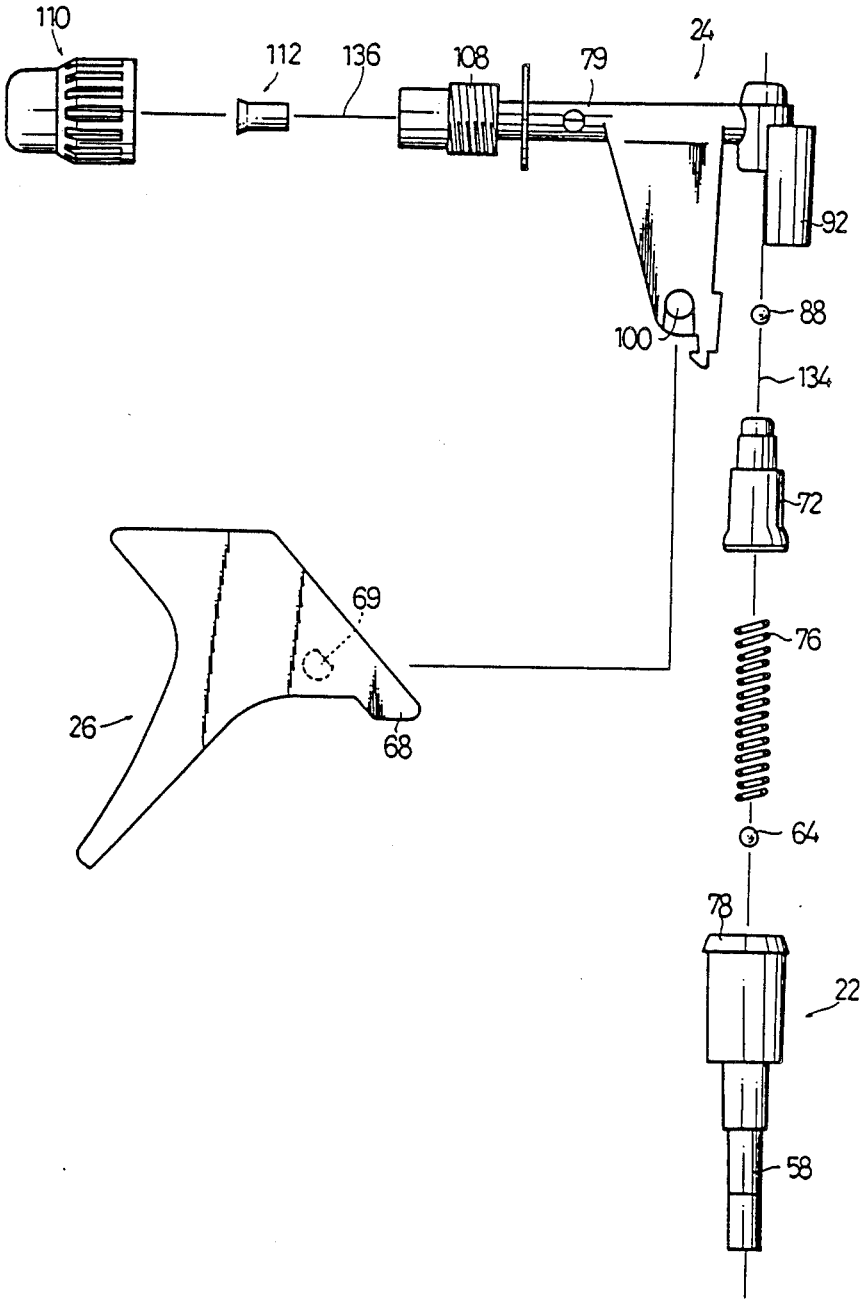
FIG. 17 is an exploded view of the inner element assembly of the dispenser shown in FIG. 1.

First, the inner elements, which will be incorporated into dispenser body 12, i.e., the piston 24, the trigger 26, the cylinder 22, and the like, are combined into one unit. More precisely, as is shown in FIG. 17, the cylinder 22, the primary valve 64, the return spring 76 the piston body 72 the secondary valve 88 are sequentially aligned along the vertical axis 134 of the piston 24. The cylinder 22, now containing the elements 64, 76, 72, and 88, is pushed onto the piston 24, whereby the primary valve 64, the return spring 76, the piston body 72, and the secondary valve 88 are simultaneously incorporated into the piston 24. That is, the secondary valve 88 is mounted on the upper end of the cylinder body 72; the primary valve 64, the return spring 76, and the piston body 72 are then contained in the cylinder 22; finally, the cylinder 22 is pushed onto the nozzle 79. As the cylinder 22 is gradually inserted into the piston 24, the hook-shaped engagement member 94 is pushed by the annular engagement member 78 of the cylinder 22 and is thus bent outward in the radial direction of the support cylinder 92. As soon as the annular engagement member 78 moves above the hook-shaped engagement member 94, the member 94 bends by itself to return to its initial position, due to its elasticity, and thus engages with the ember 78 of the cylinder 22. As has been described, almost front half of the support cylinder 92 has been cut away, the hook-shaped engagement member 94 is sufficiently elastic, so that the annular engagement member 78 can easily engage with the member 94 even when the cylinder 22 is pushed up with a small force. Once the engagement members 78 and 94 have engaged with each other, the cylinder 22 is supported by the piston 24, and remains at its initial position against the force of the return spring 76.

The engagement members 78 and 94 have a cross section shaped like a hook. However, their cross sections can be differently shaped, provided these members 78 and 95 firmly engage with each other, thus supporting the cylinder 22 in the initial position.

The pins 69 of the trigger 26 are aligned axially with the holes 100 of plates 98 and then the trigger 26 is pushed into the piston 24 until the pins 69 are fitted into the holes 100. After the pins 69 have been fitted into the holes 100, the trigger 26 is swingably supported by the piston 24.

Thereafter, as is shown in FIG. 17, the spinner 112 and nozzle cap 110 are aligned along the horizontal axis 136 of the piston 24. The nozzle cap 110 is mounted on the nozzle 79 and rotated, so as to come into screw engagement with the externally threaded portion 108 of the nozzle 79. As a result, the nozzle cap 110 is mounted on the distal end of the nozzle 79, and the spinner 112 is incorporated into the nozzle 79.

The cylinder 22, the elements 64, 78, 72 and 88, the trigger 26, the nozzle cap 110, the spinner 112 need not be attached to, and incorporated into the piston 24 in the specific order described above. Needless to say, they can be attached to, or inserted into, the piston 24 in a different order.

For simplicity of explanation, the unit comprised of the piston 24, the cylinder 22, the elements 64, 78, 72 and 88, the trigger 26, the nozzle cap 110, and the spinner 112 will be hereinafter called "inner-element assembly 138."

Figure 18:
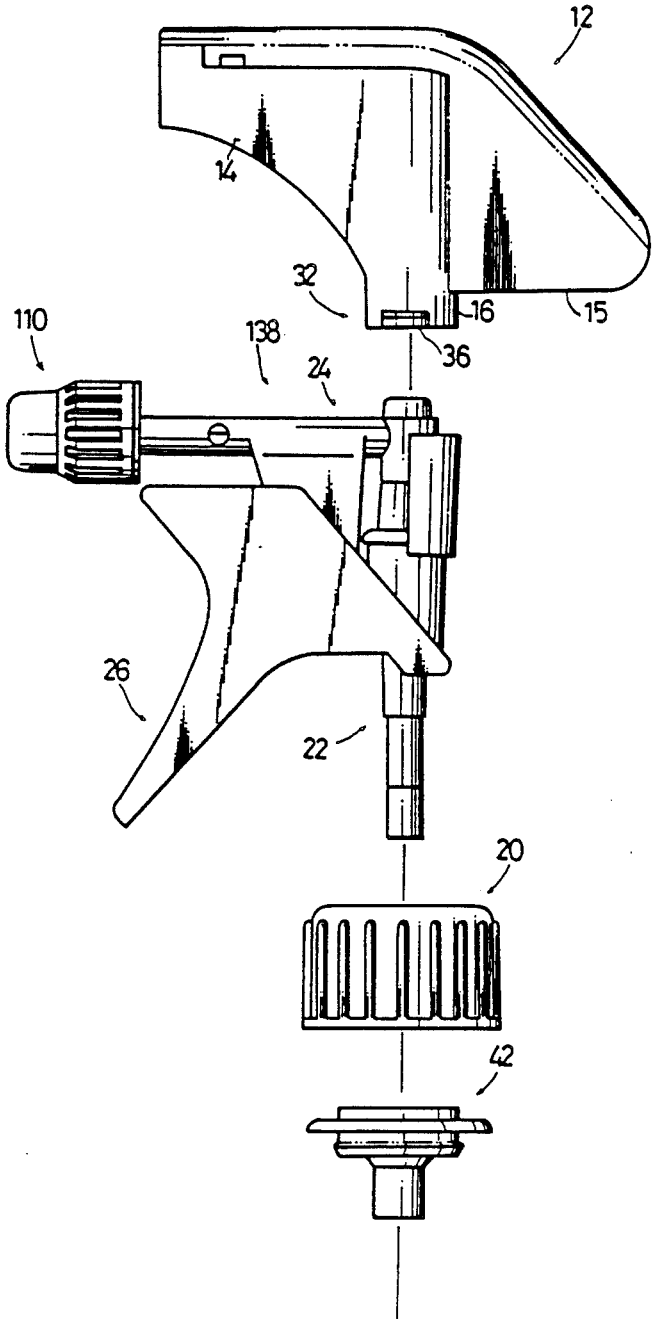
FIG. 18 is an exploded view of the trigger type dispenser.

After the inner-element assembly 138 has been formed, as has been explained above, the assembly 138, the bottle cap 20, and the sealing collar 42 are aligned coaxially with the lower portion 16 of the dispenser body 12, as is illustrated in FIG. 18. Then, the sealing collar 42, which is located lower-most, is pushed upward until the engagement member 36 of the lower body portion 16 engages with the distal end 30 of the bottle cap 20, thereby attaching the bottle cap 20 to the lower body portion 16 and, simultaneously, incorporate the inner-element assembly 138 into the lower body portion 16. At the same time, the sealing collar 42 is clamped between the projection 43 of the bottle cap 20 and the lower end of the body portion 16, and the sealing collar 42 is, therefore, connected to the lower body portion 16. As a result, the dispenser 10 is assembled. Of course, instead of pushing 16, the lower body portion 16 can be pushed downward onto the upper end of the bottle cap 20 and the sealing collar 42, with the inner-element assembly 138 partly incorporated in the lower body portion 16.

According to the present invention, as has been described, the cylinder 22 and the piston 24 are not molded integrally with the dispenser body 12, and the inlet conduit 60 and the outlet conduit 80 are formed in the cylinder 22 and the piston 24, respectively. In other words, the dispenser body 12 has neither the inlet conduit 60 nor the outlet conduit 80; it has the lower body portion 16 which extends vertically downward. Hence, the dispenser body 12 is simple in structure, and the cavity of the mold for forming the dispenser body 12 is equally simple in shape. The cycle of the injection molding of the body 12 can therefore be short.

Figure 19:
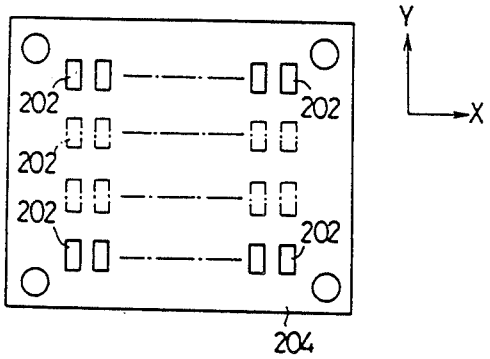
FIG. 19 is a plan view schematically showing a stationary mold used for molding dispenser bodies.

Further, as has been described, the outlet conduit 80, which extends at right angles to the axis of the lower body portion 16, is not formed in the dispenser body 12. For this reason, the dispenser body 12 can be injection-molded, only by moving the movable half of the mold, without the necessity of using cores designed for forming the outlet conduit 80. Three or more rows of cavities can, therefore, be cut in the stationary half of the mold, in contrast to the stationary mold 204 for forming the body of the known trigger type dispenser, which has only two rows of cavities 202, spaced apart in the direction of arrow Y, as is illustrated in FIG. 19. Hence, according to the present invention, more dispenser bodies 12 can be molded in each injection cycle. In FIG. 19, the rectangles drawn in one-dot chain lines represent additional cavities 202 formed in the stationary mold 204 for forming the dispenser bodies 12.

Since the dispenser body 12 is simple in structure, it can be molded within a short injection cycle, and many dispenser bodies can be molded in each injection cycle. Hence, the dispenser body 12 can be manufactured in great quantities. Moreover since the cavities of the mold for forming the dispenser body 12 have a simple shape, the mold can be made at low cost.

As has been described above, the piston 24 can be molded, with the plates 98 extending horizontally as is indicated by the one-dot chain lines in FIG. 11. Therefore, it suffices to cut two shallow cavities in the mold for forming the nozzle 79, both being located near the parting line of the mold. The piston 24 can be easily molded and, thus, in great quantities. Since the mold for forming the piston 24 has a simple structure, it can be manufactured at low cost.

In the embodiment described above, the piston 24 is incorporated in the dispenser body 12, whereas the cylinder 22 is moved upward when the trigger 26 is squeezed, and is moved downward when the trigger 28 is released. As an alternative, the cylinder 22 can be fixed within the dispenser body 12 and the piston 24 can be moved up and down when the trigger 26 is squeezed and released. This is because the cylinder 22 having the inlet conduit 60, and the piston 24 having the outlet conduit 80 are molded separately from the dispenser body 12, thereby making it possible to mold the body 12 in great quantities.

As has been described above, the piston 24, the cylinder 22 and the trigger 26 are aligned coaxially, and the cylinder 22 and the trigger 26 are attached to the piston 24, thereby easily forming the inner-element assembly 138. The inner-element assembly 138 cannot be disintegrated easily. The dispenser 10 can be completed, by merely pushing the bottle cap 20, the sealing collar 42, and the assembly 138 onto the dispenser body 12, while keeping them in axial alignment with the dispenser body 12. As has also been explained already, the dispenser body 12 can be molded in large quantities regardless of whether the cylinder 22 or the piston 24 is movable. However, since the movable element must be held in the initial position while the dispenser 10 is being assembled, it is desirable that the cylinder 22 be movable as in the above embodiment.

The inner-element assembly 138 can be assembled easily and quickly, only if the cylinder 22, the piston 24, and the trigger 26 have been aligned coaxially with one another. Once the assembly 138 has been thus formed, the dispenser 10 can be assembled merely by aligning the dispenser body 12, the assembly 138, the bottle cap 20, and the sealing collar 42 coaxially with one another, and then couple them together. Obviously, the dispenser 10 can be assembled easily and quickly.

Once the inner-element assembly 138 has been assembled the cylinder 22 remains firmly attached to the piston 24 since the annular engagement member 78 of the cylinder 22 engages with the hook-shaped engagement member 94 of the piston 24. Thus, the assembly 138 can hardly be disintegrated while it is being stored or transported.

As can be understood from FIG. 1, the bottle cap 20 and the sealing collar 42 have relatively simple structures. They can be easily be made by injection molding, like the dispenser body 12. Besides, as has been explained, the dispenser body 12, the bottle cap 20, the sealing collar 42, and the inner-element assembly 138 can be coupled together, thus assembling the dispenser 10, by either pushing down the body 12 or pulling up the sealing collar 42. In short, it is nor technically difficult to injection-mold the components of the dispenser 10, or to connect these components, thereby to manufacture the dispenser 10. In view of this fact, the trigger type dispenser 10 according to the present invention can be manufactured easily in the industrially developing countries, as well as the industrially advanced countries.

Since the inner-element assembly 138 remains integrated while being transported, it can be supplied from the main factory, where it has been made, to other remote factories. Hence the dispenser 10 can be manufactured in these remote factories in a knock-down scheme, that is, by coupling the assembly 138 and the other unfinished products, i.e., the bottle cap 20 and the sealing collar 42, with the dispenser body 12. As is generally known, such knock-down manufacture of products does not require skilled labor. In view of this, the trigger type dispenser 10 according to this invention can be manufactured in the knock-down scheme, even in those regions where skilled labor is hard to obtain.

The inner-element assembly 138 can be modified, thereby to provide various types of dispensers. For example, a tip having a foamed rubber screen, a meshed screen, or the like can be attached to the nozzle cap 110, in which case a foaming-type dispenser can be provided. Thus, if various modifications of the assembly 138 are manufactured in the main factory and are supplied to the other factories existing all over the world, where they are needed, the manufacture program and design alteration of the dispenser can be controlled on a gloval basis.

The dispenser 10 according to the present invention is completed when the suction tube 66 is fitted in the small-diameter section 58 of the cylinder 22. Needless to say, the suction tube 66 can be made easily, and can be fitted easily into the small diameter section 58.

The nozzle cap 110 and the spinner 112 are combined, constituting a mechanism 140 for switching the pattern in which the pressurized liquid flows from the orifice 113. When the nozzle cap 110 is rotated and moved rearward, or to the right (FIG. 13), the cylinder 122 of the nozzle cap 110 enters the circular recess 118 of the spinner 112, and the free end of this cylinder 122 contacts the bottom 119 of the recess 118, as is illustrated in FIG. 13. As a result, the liquid passages 114 are closed, whereby the orifice 113 is disconnected from the outlet conduit 80 of the nozzle 79. The pressurized liquid is therefore completely prevented from flowing from the passages 114 into the orifice 113 via the tangential grooves 115 and the circular recess 118. Hence, in this condition, the liquid never leaks even if the trigger 26 is squeezed by error. The residual liquid, if any in the passages 114, dose not leak, either. Thus, only if the nozzle cap 110 is rotated until its cylinder 122 abuts on the bottom 119 of the circular recess 118, the cap 110 can be set in its off-position, so as to prevent the pressurized liquid from leaking. Namely, the nozzle cap 110 can be set easily in the off position.

Despite its simple structure, the nozzle cap 110 can cooperate with the spinner 112 to prevent the pressurized liquid from leading via the orifice 113 even if the trigger 26 is squeezed by mistake. Therefore, unlike the conventional trigger type dispenser, the dispenser 10 according to this invention need not be provided with a trigger-locking mechanism or a plug means for closing the orifice 113. The dispenser 10 according to the present invention is, thus, less complex in structure than the conventional one, and is superior to the conventional dispenser in terms of outer appearance.

In the embodiment, the nozzle cap 110 is in screw engagement with the externally threaded portion 108 of the nozzle 79, and moves back and forth when rotated Instead, the nozzle cap 110 can be in sliding contact with the nozzle 79. Also, the nozzle cap 110 can be directly attached on the dispenser body 12.

It should be noted that the trigger type dispenser 10 is transported for sale, with the nozzle cap 110 is held in the off-position, if the dispenser 10 is connected to the container 18 filled with a liquid.

Figure 20:
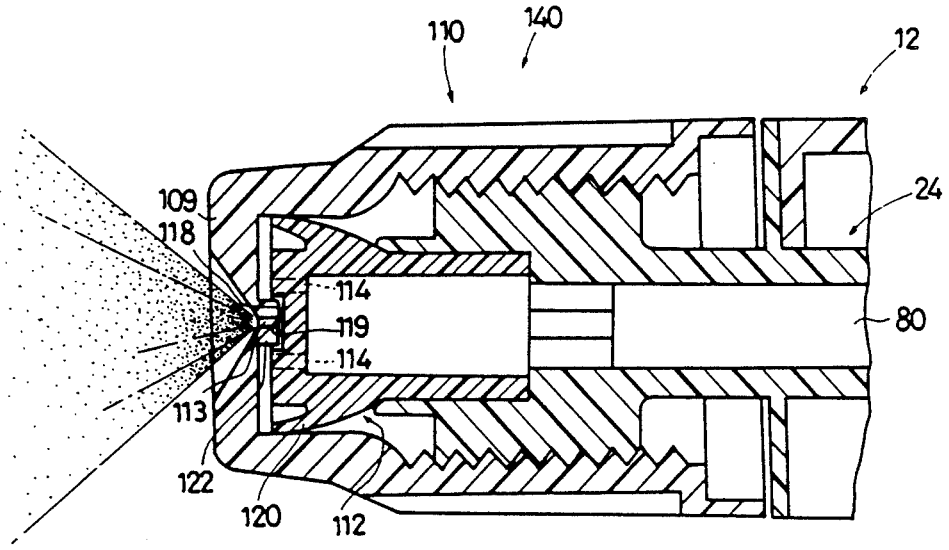
FIG. 20 is a longitudinal sectional view showing the mechanism of FIG. 13, which is located at a liquid-spraying position.

To use the dispenser 10, the nozzle cap 110 is rotated, thereby moving it from its off-position to the left (FIG. 1). Then, as is shown in FIG. 20, the inner cylinder 122 of the cap 110 is slightly moved away from the bottom 119 of the circular recess 118 of the spinner 112. As a result, the outlet conduit 80 of the nozzle 79 is connected to the orifice 113 via the gap between the bottom lid and the cylinder 122. In this condition, the liquid passages 114 communicate with the circular recess 118 via the tangential grooves 115, as is illustrated in FIG. 15. Therefore, the pressurized liquid flows from the outlet conduit 80 of the nozzle 79 into the recess 118 through the liquid passages 114, swirling within the recess 118 and flowing into the orifice 113. Hence, the liquid is ejected outside via the orifice 113.

A part of the liquid flowing from the passages 114 into the circular recess 118 intends to flow along the outer periphery of the inner cylinder 122 and then through the gap between the inner surface of the distal end of the cap 110 and the distal end of the spinner 112. However, the flared seal 120 blocks the flow of the liquid.

As is shown in FIG. 20, the circular recess 118 and the cylinder 122 are circular and concentric. The shapes of the recess 118 and the cylinder 122, and the positional relationship between them, are not limited to these, however, provided the recess 118 and the cylinder 122 cause the pressurized liquid to swirl into the orifice 113.

Figure 21:
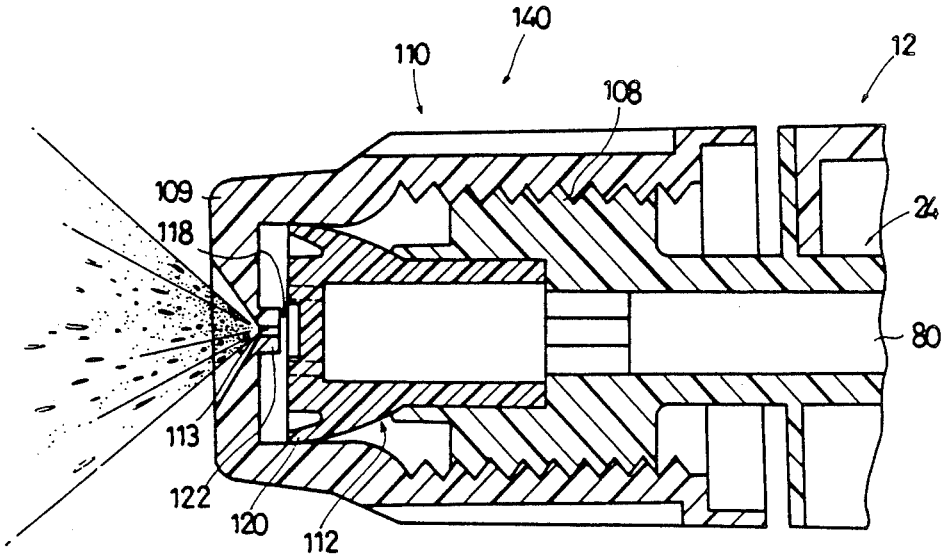
FIG. 21 is a longitudinal sectional view showing the mechanism of FIG. 13, which is located at a liquid-jetting position.

When the nozzle cap 110 assumes the position shown in FIG. 20 (hereinafter referred to as "liquid-spraying position"), the liquid is sprayed from the nozzle 79 each time the trigger 26 is squeezed. To eject the liquid from the nozzle 79 in the form of a jet stream, the nozzle cap 110 is rotated, thus moving the bottom 109 of the cap 110 farther from the distal end of the spinner 112, as is illustrated in FIG. 21. In other words, the nozzle cap 110 is further moved to the left to the position shown in FIG. 21 (hereinafter referred to as "liquid-jetting position"). As long as the cap 110 stays at the liquid-jetting position, a relatively wide gap is provided between the inner cylinder 122 and the bottom 119 of the circular recess 118. Since this gap is too wide, the pressurized liquid flowing from the passages 114 into the recess 118 can no longer swirl, and is ejected outside through the orifice 113 in the form of a jet stream, as is shown in FIG. 21.

As has been explained in the preceding paragraph, the nozzle cap 110 can be easily moved between the liquid-spraying position and the liquid-jetting position, when it is rotated in one direction and in the opposite direction. When the nozzle cap 110 is thus moved to either position, the flowing-pattern of the liquid is quickly and easily switched. Since the orifice 113 is cut in the center of the bottom 119 of the nozzle cap 110, the liquid is ejected from the same position whenever the trigger 26 is squeezed, provided that the nozzle cap 110 is located in either the liquid spraying position or the liquid-jetting position.

Assuming that the nozzle cap 110 is in the liquid-jetting position, the cap 110 can be moved to the right, thus first assuming the liquid-spraying position (FIG. 20), and then the off-position (FIG. 13).

After the liquid has been sprayed or jetted, the nozzle cap 110 is rotated until the cylinder 122 abuts on the bottom 119 of the circular recess 118. Then, the cap 110 can no longer be moved father to the right. It is at this moment that the nozzle cap 110 reaches the off-position. The user can easily know that the cap 110 has been set in the off-position.

As has been explained, the flowing-pattern switching mechanism 140 can not only change the flowing-pattern of the liquid quickly, but also reliably set the nozzle cap 110 in the off-position.

It is desirable that marks be imprinted on the upper body portion 14 and the nozzle cap 110, thereby to render it easy for the user to recognize whether the cap 110 is set in the liquid-spraying position or the liquid-jetting position. More specifically, a mark "◁" should be imprinted on the upper body portion 14, and words "SPRAY" and "JET" should be imprinted on the cap 110, spaced apart from each other in the circumferential direction of the cap 110. If this measure has been taken, the cap 110 can be set in the liquid-spraying position when it is rotated until the word "SPRAY" is aligned with the mark "◁", and in the liquid-jetting position when it is rotated until the word "JET" is aligned with the mark "◁". Hence, the nozzle cap 110 can be located in either position, fast and accurately.

As has been pointed out, the nozzle cap 110 can be easily set in the off-position by being moved to the right until the cylinder 122 contacts the bottom 119 of the circular recess 118. However, when the user rotates the cap 110 with an excessively great force, thus moving the cap 110 to the right, the cylinder 112 and or the recess 118 may be damaged. To prevent such a damage, it is desirable that the word "OFF" be imprinted on the nozzle cap 110, and that the user stop rotating the cap 110 when the word "OFF" s aligned with the mark "◁" imprinted on the upper body portion 14.

Figure 22:
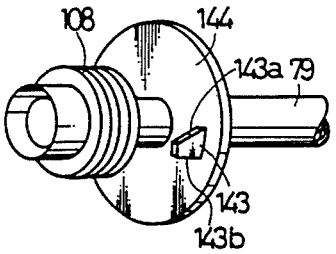
FIG. 22 is a perspective view of a nozzle which is used in the dispenser.
Figure 23:
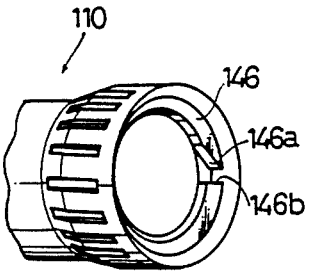
FIG. 23 is a perspective view of the nozzle cap which is used in the dispenser.

In order to prevent an excessive movement of the cap 110 to the right, a stopper mechanism for inhibiting the cap 110 from further rotating after it has assumed the off-position is provided, as is shown in FIG. 22 and FIG. 23. As is indicated in FIG. 22, a thin disc 114 having a stopper 143 is mounted on the nozzle 79 right behind the externally threaded portion 108. Assuming that the portion 108 is a right-handed screw, the upper edge **143*a* of the stopper 143 is inclined to the disc 144, and the lower edge thereof extends perpendicular to the disc 144. As is shown in FIG. 23, the nozzle cap 110 has a flange 146 connected the rear. This flange 146 has a slit, and thus has two ends 146*a* and 146*b*. The upper end 146*a* is inclined, whereas the lower end 146*b* extends in the radial direction of the flange 146**.

When the nozzle cap 110 in the off-position (FIG. 1) is rotated clockwise to move further to the right, the inclined edge **143*a* of the stopper 143 abuts on the inclined end 146*a* of the flange 146, whereby the flange 146 pushes stopper 143 backwardly. As a result, the thin disk 144, which functions as a leaf spring, is deformed such that the stopper 143 slips out of the slit of the flange 146. Hence, the nozzle cap 110 can be further rotated clockwise. When the cap 110 is thereafter rotated counterclockwise, then the lower edge 143*b* of the stopper 143 abuts on the lower end 146*b* of the flange 146. In this case, the thin disc 114 is not deformed, and the stopper 143 remains in abutment with the lower end 146*b* of the flange 146, and the nozzle cap 110 cannot be further rotated counterclockwise. The thin disc 144 having the stopper 143, and the flange 146 having a slit are simple in structure, and yet can cooperate to prevent readily an excessive movement of the cap 110** to the right.

In the embodiment described above, the flowing-pattern switching mechanism 140 is used to change the pattern in which a pressurized liquid is ejected from the orifice 113. This mechanism 140 can be used not only in a trigger type dispenser, but in other types of dispenser, such as a push-pull type dispenser wherein a push-button is pushed to lower a piston, so as to pressurize a liquid, a dispenser having a container which can be collapsed to pressurize a liquid, or a motor-driven dispenser wherein an electric motor is used to pressurize a liquid.

What is claimed is:

1. A manually operated trigger type dispenser, comprising:

a dispenser body made of a synthetic resin and including an upper portion and a lower portion vertically extending from the upper portion;

a bottle cap made of a bottomed hollow cylinder, for detachably coupling said lower portion of said dispenser body with a neck of a container filled with a liquid to be dispensed;

a cylinder defining a pump chamber and engaged with a swingable trigger, so as to reciprocate between an upper operational position and a lower non-operational position when said trigger is squeezed and released;

a substantially L-shaped piston made of a synthetic resin and including a horizontal nozzle interposed within the upper portion of said dispenser body, and a vertical piston body located within the lower portion of said dispenser body, for guiding said cylinder;

inlet conduit means formed within said cylinder and connected to said pump chamber through a primary valve, for supplying the liquid from said container into said pump chamber;

a nozzle cap having an orifice and attached to a distal end of the nozzle of said piston;

outlet conduit means formed within the nozzle of said piston and connected to said pump chamber through a secondary valve, for dispensing the liquid pressurized within said pump chamber, through the orifice of said nozzle cap; and a return spring biasing said cylinder to the lower non operational position thereof; and said lower portion of said dispenser body having a slit in the front section of a lower end of said lower portion to allow the passage of said L-shaped piston and the rear end of said trigger through said slit, and an engagement member fitting the lower end of said dispenser body in a proximal end of said bottle cap, by utilizing the elasticity imparted to the lower end of said dispenser body due to the existence of said slit, thereby holding the proximal end of said bottle cap between the lower edge of the rear section of said lower portion of said dispenser body and said engagement member.

2. A dispenser according to claim 1, wherein said engagement member has a flange having a lower inclined surface for guiding the proximal end of said bottle cap upwardly, and an upper surface extending substantially parallel to the lower surface of the proximal end of said bottle cap, for preventing said bottle cap from slipping from said dispenser body.

3. A dispenser according to claim 1, wherein:

said cylinder has a first hook-shaped engagement member at the upper end thereof;

said piston includes a support cylinder surrounding said piston body and a second hook-shaped engagement member at the lower end thereof, which is engaged with the first hook-shaped engagement member of said cylinder, thereby holding said cylinder in the lower non-operational position thereof.

4. A dispenser according to claim 3, wherein said support cylinder of said piston has a notch therein, and said second hook-shaped engagement member of said piston has two portions spaced apart from each other.

5. A dispenser according to claim 1, wherein:

said nozzle cap is a bottomed cylinder molded of a synthetic resin, and includes a cylinder defining said orifice; and a spinner in the form of a bottomed cylinder, is located within said nozzle cap, is molded of a synthetic resin, and has a through hole in the bottom of the spinner and communicating with the outlet conduit of said piston, a recess in the bottom of the spinner and opposing the orifice of said nozzle cap, and a groove in the bottom of the spinner, extending tangentially to said recess and communicating said recess with said through hole, the bottom of said recess being capable of contacting the cylinder of said nozzle cap.

6. A spinner for use in a dispenser, comprising a bottomed hollow cylinder made of a synthetic resin, adapted to be located within a nozzle cap and connected to a distal end of a nozzle, and including means for causing a pressurized liquid flowing through the nozzle to swirl, said spinner further comprising:

a through hole in a bottom of said bottomed hollow cylinder of said spinner communicating with a liquid passage of said nozzle, a recess in the center portion of the bottom and opposing an orifice made in said nozzle cap, and a groove in the bottom, said groove extending tangentially to the recess and communicating the recess with the through hole, the bottom of said recess being capable of contacting a cylinder defining the orifice of said nozzle cap.

7. A flow-pattern switching mechanism for use in a dispenser, comprising:

a spinner comprising a bottomed hollow cylinder having a through hole in a bottom thereof and communicating with a passage of a nozzle, a recess in the center of the bottom, and a groove in the bottom, the groove extending tangentially to the recess and communicating the recess with the liquid passage; and a nozzle cap comprising a bottomed cylinder having an orifice in the center of the bottom thereof and opposed to the recess of said spinner, and a cylinder extending backward from the bottom of said bottomed cylinder of said nozzle cap and being capable of contacting the bottom of the recess of said spinner, and which is mounted on a distal end of the nozzle, with said spinner attached to the distal end of the nozzle, so as to move back and forth in the axial direction of the nozzle, whereby the gap between the bottom of the nozzle cap and the recess of said spinner is adjusted to change the pattern in which the pressurized liquid can be ejected from the orifice.

* * * * *